US008950342B2

(12) United States Patent
Plattner

(10) Patent No.: US 8,950,342 B2
(45) Date of Patent: Feb. 10, 2015

(54) PLASTIC PALLET

(71) Applicant: Georg UTZ Holding AG, Bremgarten (CH)

(72) Inventor: Patrik Plattner, Hermetschwil-Staffeln (CH)

(73) Assignee: Georg Utz Holding AG, Bremgarten (CH)

( * ) Notice: Subject to any disclaimer, the term of this patent is extended or adjusted under 35 U.S.C. 154(b) by 0 days.

(21) Appl. No.: 14/080,375

(22) Filed: Nov. 14, 2013

(65) Prior Publication Data

US 2014/0137775 A1 May 22, 2014

(30) Foreign Application Priority Data

Nov. 15, 2012 (CH) ..... 2385/12

(51) Int. Cl.
*B65D 19/12* (2006.01)
*B65D 19/00* (2006.01)

(52) U.S. Cl.
CPC ..... *B65D 19/0016* (2013.01); *B65D 19/001* (2013.01); *B65D 2519/00034* (2013.01); *B65D 2519/00069* (2013.01); *B65D 2519/00129* (2013.01); *B65D 2519/00139* (2013.01); *B65D 2519/00273* (2013.01); *B65D 2519/00288* (2013.01); *B65D 2519/00318* (2013.01); *B65D 2519/00333* (2013.01); *B65D 2519/00402* (2013.01); *B65D 2519/00437* (2013.01); *B65D 2519/00567* (2013.01); *B65D 2519/0084* (2013.01)
USPC ..... 108/56.3; 108/57.25

(58) Field of Classification Search
CPC ..... B65D 19/0012; B65D 19/0018; B65D 19/0036; B65D 19/0038; B65D 19/0048; B65D 19/0081
USPC ..... 108/51.11, 56.1, 56.3, 57.25–57.28
See application file for complete search history.

(56) References Cited

U.S. PATENT DOCUMENTS

| | | | | |
|---|---|---|---|---|
| 4,735,154 | A * | 4/1988 | Hemery | 108/56.1 |
| 5,094,175 | A * | 3/1992 | Christie | 108/56.1 |
| 5,483,899 | A | 1/1996 | Christie | |
| 5,950,545 | A * | 9/1999 | Shuert | 108/53.3 |
| 6,021,721 | A * | 2/2000 | Rushton | 108/56.3 |
| 6,173,659 | B1 * | 1/2001 | Danks et al. | 108/54.1 |
| 6,199,488 | B1 * | 3/2001 | Favaron et al. | 108/57.25 |
| 6,622,642 | B2 * | 9/2003 | Ohanesian | 108/57.25 |
| 2003/0126314 | A1 | 7/2003 | Litt | |
| 2003/0233963 | A1 | 12/2003 | Fan | |
| 2007/0234933 | A1 | 10/2007 | Donnell, Jr. et al. | |
| 2011/0259249 | A1 * | 10/2011 | Ogburn et al. | 108/57.33 |
| 2012/0304898 | A1 | 12/2012 | Dubois et al. | |
| 2012/0325125 | A1 * | 12/2012 | Apps et al. | 108/57.25 |

FOREIGN PATENT DOCUMENTS

| | | |
|---|---|---|
| CH | 685 549 | 8/1995 |
| CH | 702 628 | 8/2011 |
| DE | 10 2007 020277 A1 | 11/2008 |
| DE | 20 2011 104024 U1 | 9/2011 |
| EP | 1829787 A1 | 9/2007 |
| GB | 2 421 939 | 7/2006 |

* cited by examiner

*Primary Examiner* — Matthew Ing
(74) *Attorney, Agent, or Firm* — Henry M. Feiereisen LLC

(57) ABSTRACT

A plastic pallet has a top part and a bottom part and multiple runners and foot elements. The foot elements have multiple ribs which extend over the entire height of the foot elements. The foot elements of the top part and bottom part are fully insertable into each other and lockable by means of latching connections, wherein the joined foot elements have a double wall. The ribs of the foot elements have semicircular recesses for receiving reinforcement tubes, and projections for fixing the tubes.

10 Claims, 4 Drawing Sheets

PLASTIC PALLET

CROSS-REFERENCES TO RELATED APPLICATIONS

This application claims the priority of Swiss Patent Application, Serial No. CH02385/12, filed Nov. 15, 2012, pursuant to 35 U.S.C. 119(a)-(d), the disclosure of which is incorporated herein by reference.

BACKGROUND OF THE INVENTION

The present invention relates to a plastic pallet.

The following discussion of related art is provided to assist the reader in understanding the advantages of the invention, and is not to be construed as an admission that this related art is prior art to this invention.

Pallets are used for storing and transporting goods. The pallets keep the goods away from the ground so that they can be lifted by a fork lift and transported. Plastic pallets are lighter than wood pallets. They are often reinforced by reinforcement tubes made of metal or composite materials in order to increase their load bearing capacity and bending stiffness.

Plastic pallets can be configured two-part and consist of a top part and a bottom part which can be joined so as to engage in one another and be connected. The top part has three runners and 9 feet. For example CH 702628 discloses a pallet with a hollow bottom part which is provided with ribs and which is welded to the top part. A border on the top part which is oriented towards the bottom part enables on one hand simple handling during welding and on the other hand achieves a flat connection of high accuracy and a smooth border.

CH 685549 discloses a plastic pallet with five reinforcement tubes which are clampingly fastened in semicircular recesses.

GB 242-1939 discloses a plastic pallet with a flat top part and flat bottom part and nine separate feet via which the top and bottom part are interconnected wherein both ends of the feet are respectively fastened by means of snap closures on the top part and bottom part of the pallet.

It would be desirable and advantageous to provide an improved plastic pallet with which has an increased impact resistance.

SUMMARY OF THE INVENTION

According to one aspect of the present invention, a plastic pallet includes a flat top part and a flat bottom part, the top part and bottom part each having foot elements which project perpendicularly from respective surfaces of the top and bottom parts, wherein the foot elements each have ribs extending over an entire height of the foot elements, wherein the foot elements of the top part and the foot elements of the bottom are fully insertable into each other and include latching elements, and are fastenable to each other by latching engagement of the latching elements.

According to another advantageous feature of the invention, the ribs of the foot elements of the bottom part and the top part can each have semicircular recesses for receiving reinforcement tubes.

According to another advantageous feature of the invention, the ribs of the foot element can each have one or more protrusions for fixing a reinforcement tube which can be arranged in the recesses.

According to another advantageous feature of the invention, the foot elements of the top part and the bottom part can be integrated as one piece with the top part or the bottom part. This configuration together with the latching connection enables assembling of a pallet from only two parts without the need of tools.

When joining the top and bottom part the ribs of the foot element of the two parts can be fully inserted into each other so that their ribs are arranged parallel to each other over their entire length, thereby forming the feet of the pallet, wherein the ribs form double walls of the feet. The double walls increase the strength of the foot elements so that the foot elements are more robust and can resist impact of a forklift and other items and can therefore be used over a longer period of time.

Preferably, the foot elements of the bottom part or the top part additionally have a rectangular wall which surrounds a foot element on all four sides. The rib construction of the foot elements enable a fast and simple assembly of the two parts of the pallet and the latching connection elements arranged on the ribs enable an efficient locking without requiring tools.

Depending on the desired strength of the connection of the two parts of the pallet, multiple latching elements can be integrated on the foot elements.

According to another advantageous feature of the invention, each foot element of the top part and bottom part has one or more pairs of latching elements. This further increases and ensures the strength of the foot elements.

Reinforcement tubes can be inserted into the semicircular recesses on the ribs so as to extend parallel to the sides of the pallet or parallel to the runners if present. When joining the top and bottom parts, the tubes are automatically fixed, wherein the protrusions on the ribs enable fastening of the tubes in both directions. The invention enables arrangement and simultaneous fixing of any number of tubes from one to five.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
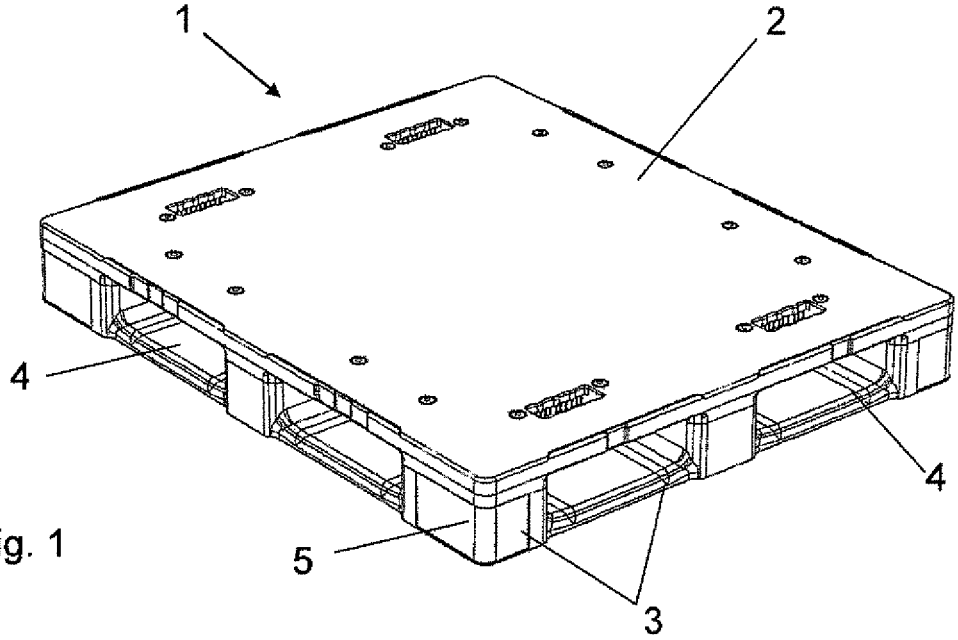
FIG. 1 shows a perspective view of the pallet according to the invention in the joint state.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a complete plastic pallet 1 according to the invention in the joined and ready to use state. It includes a flat rectangular top part 2 and a rectangular bottom part 3 which includes multiple runners 4 which lie in a plane. The plastic pallet shown in the figures has three runners which extend parallel in one direction and three runners that extend in the transverse direction, wherein two runners form a cross in the center of the pallet. The six runners are arranged so as to form a so called window constellation which is akin to a window frame with cross-shaped division by center beams as shown in particular in FIGS. 5*a* and *b*. However, the invention is also applicable to plastic pallets with only two runners in transverse direction. The top part 2 and bottom part 3 each have nine foot elements 5 which are each integrated as one piece with the top part 2 or the bottom part 3. The top part 2 and bottom part 3 are interconnected via the foot elements 5 which are arranged on the corners, the center points of the sides and in the center of the pallet. As can be seen from FIG. 1 and from the further Figures, in particular FIG. 5, the plastic pallet has three parallel extending runners 4 which extend along the sides and over the center of the rectangle. Three further parallel runners 4 extend transverse to the first runners and again along the sides and through the center so that a so-called window constellation is formed with a frame and crossed elements in the center.

Figure 2:
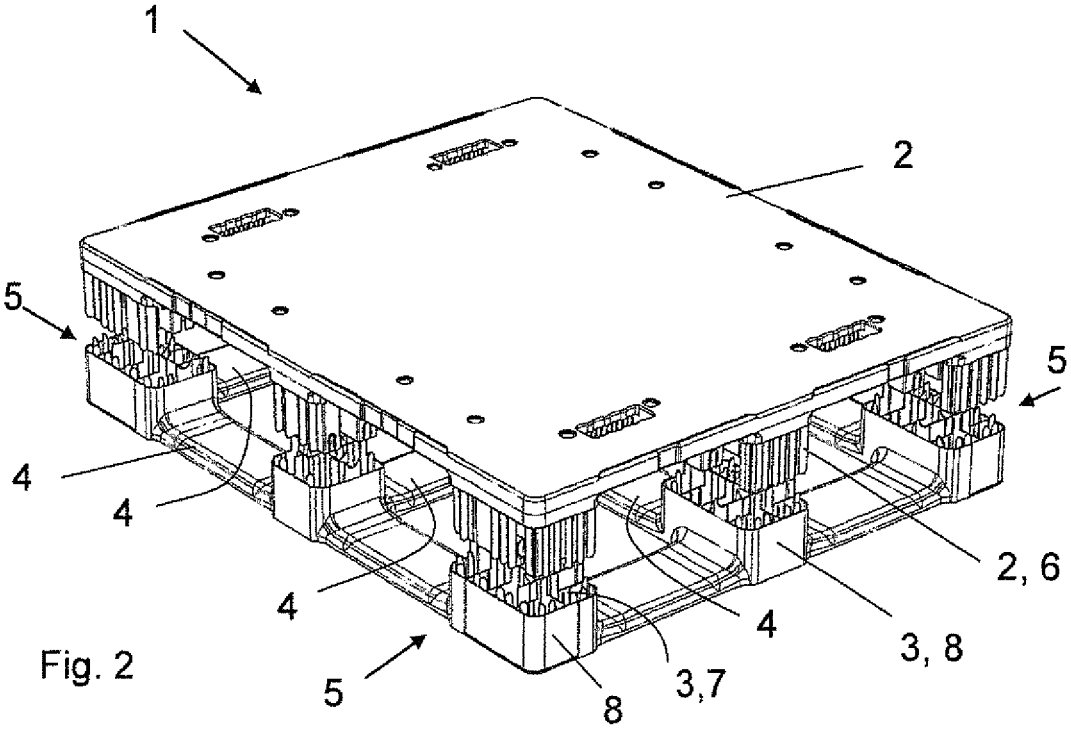
FIG. 2 shows a perspective view of the pallet according to the invention with separate view of the top part and bottom-part and the individual foot elements.

FIG. 2 shows the essential features of the invention in particular the configuration of the foot elements 5. The top part 2 and the bottom part 3 have parts of the foot elements 5 which during assembly of the two parts engage into one another and are locked. Each foot element of the bottom part 3 has a wall 8 and multiple ribs 7. The foot elements 5 of the top part 2 also have multiple ribs 6, wherein the ribs 7 of the bottom part 3 and the ribs 6 of the top part 2 have same lengths. When the foot elements 5 of the top part 2 are inserted into the foot elements 5 of the bottom part 3 a complete overlap of the ribs 6 and 7 over their entire length and with this the entire height of the foot elements and the finished feet of the pallet is achieved. This results in a reinforcement of the foot elements 5 in that they are provided with a double wall in the assembled state. As a result, damage to the foot elements by blows of a forklift or due to falling down are avoided.

Figure 3A:
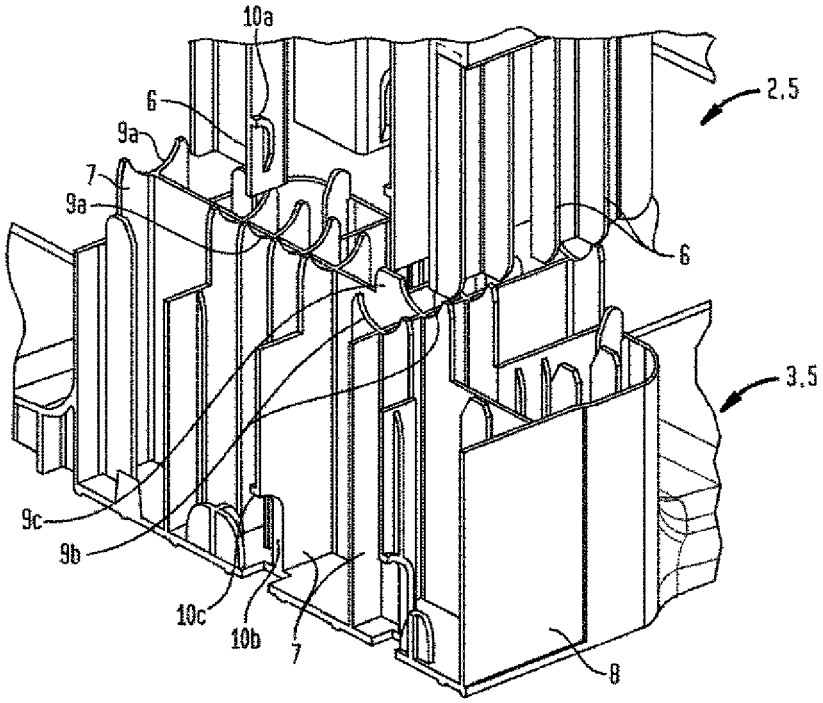
FIGS. 3*a* and *b* show respectively a detail view of a foot element in the open and joined state and in particular of the ribs of the foot element, of latching connection elements and recesses and fixations for reinforcement tubes.

An embodiment of the invention, in particular of the foot elements 5, is for example shown in FIGS. 3*a* and *b*. FIGS. 3*a* and *b* also show a device for locking the top part with the bottom part. In addition, an integration of a holder for reinforcement tubes in the ribs of the foot elements and a fastening or fixing device of such tubes are shown.

Figure 3B:
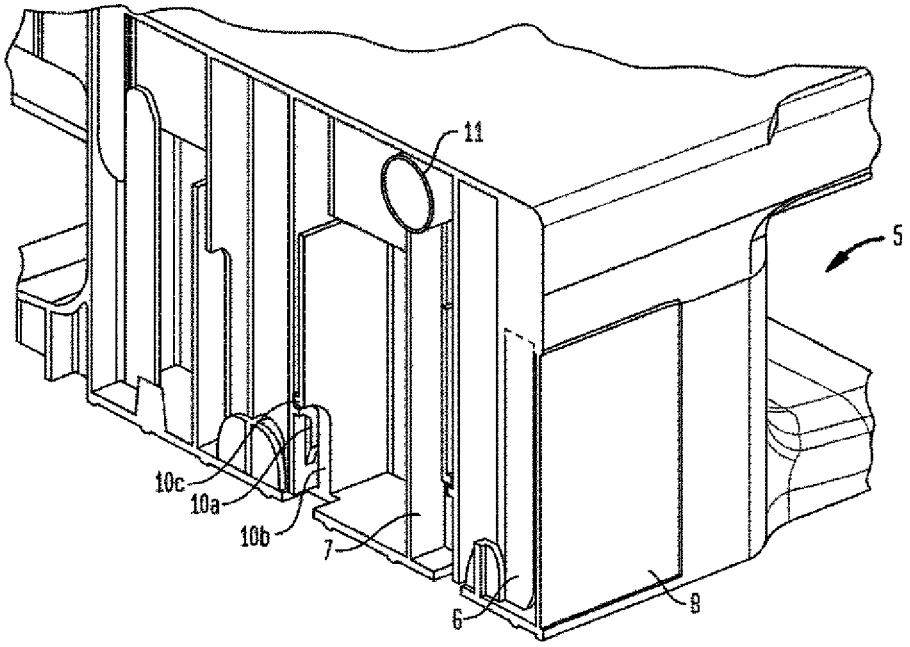

FIG. 3*a* shows an individual foot element 5 of a pallet, with multiple ribs on the top part 2 and multiple ribs 7 on the bottom part, wherein the ribs are arranged so as to be insertable into each other. The bottom part 3 also has a walling 8 which surrounds the entire foot element 5 and into which all ribs 6 of a foot element of the top part 2 can be arranged. At least one rib 6 of the top part 2 has in particular a semicircular projection 10*a* which is configured as latching element. For this, the projection 10*a* is slanted on its lower side. In order to enable a latching connection and locking of the top part with the bottom part the bottom part 3 has a recess 10*b* on a rib 7 which recess is dimensioned corresponding to the projection 10*a* on the rib 6 and can receive the projection 10*b*. In addition, this rib 7 has a further projection 10*a* which is arranged directly above the recess 10*b*, When the top part and the bottom part are inserted into each other, the ribs 6 of the top part are inserted between the ribs 7 of the bottom part 2, wherein the projection 10*a* on the rib 6 of the top part is pushed over the projection 10*c* on the rib 7 of the bottom part 3 by means of the slant of the projection 10*a*. When the projection 10*b* has passed the projection 10*c*, the projection 10*c* is guided into the recess 10*b* as shown in FIG. 3*b*. The projection 10*c* ensures a locking of the two parts and prevents the top part from sliding out of the bottom part.

As a further feature according to the invention, the plastic pallet has respective semicircular recesses 9*a* and 9*b* on the ribs 7 of the bottom part 3 as shown in FIG. 3*a*. Their shape and size correspond to the shape and size of a reinforcement tube so that the recesses can receive a reinforcement tube. Prior to insertion of top and bottom part into each other, a reinforcement tube 11 can be fixed in a first direction in the recesses 9*a* and a further tube in the transverse direction in the recesses 9*a*, as shown in FIGS. 3*b*, 4 and 5*a* and *b*.

In addition, according to FIG. 3*a*, a rib 7 of the bottom part 3, for example the one which is closest on the wall 8, has an upwardly protruding projection 9*c*, i.e., protruding in direction of the top part, which serves for fastening a reinforcement tube and to prevent a back and forth sliding in the longitudinal direction.

Figure 5A:
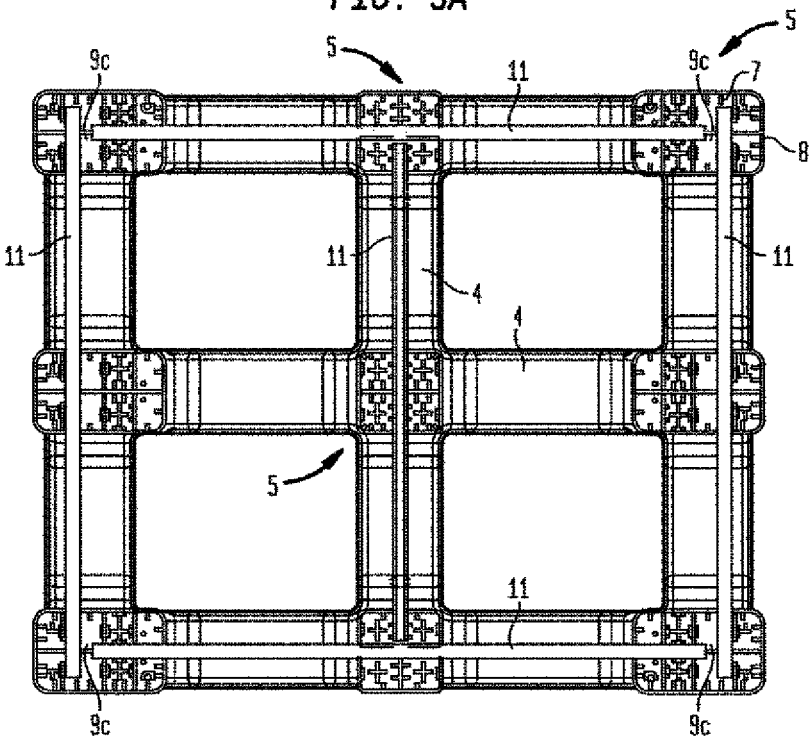
FIGS. 5*a* and *b* show respectively different arrangements of reinforcement tubes.
Figure 5B:
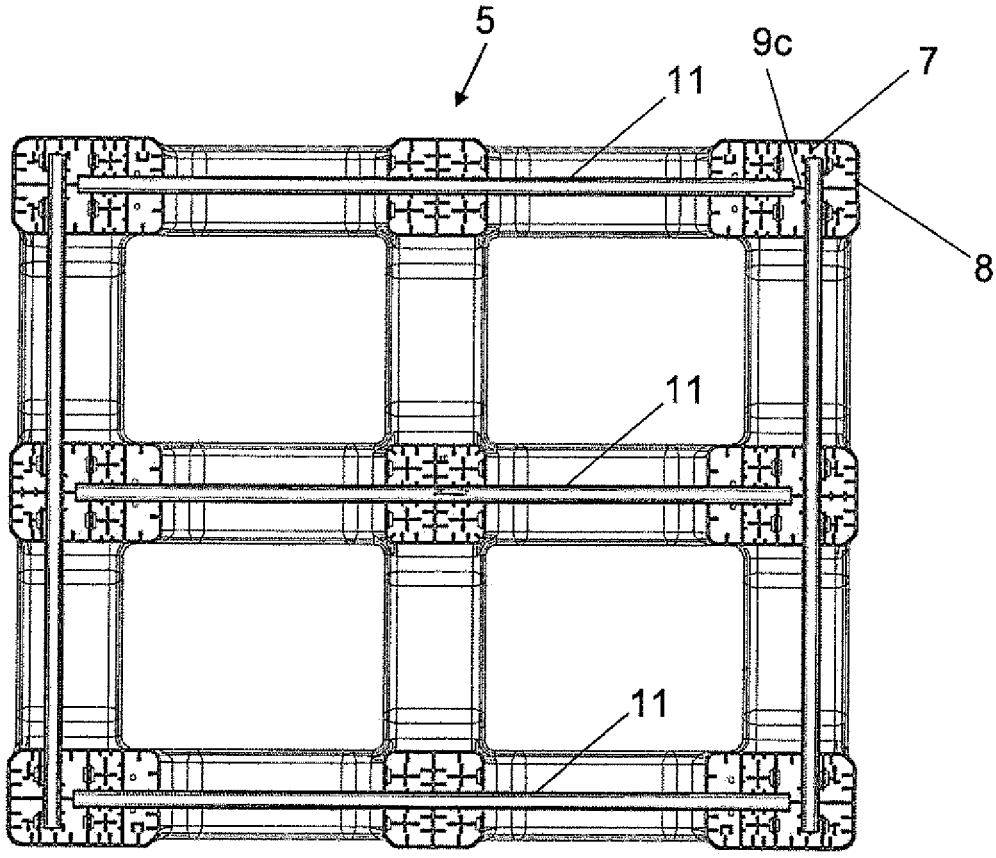

FIGS. 5*a* and *b* show in a top view two examples of arrangements of reinforcement tubes 11 by placement in recesses on the ribs of all foot elements 5. In FIG. 5*a*, two parallel extending tubes 11 are fixed in their longitudinal direction at their ends by fastenings 9*c*. Three further tubes 11 extending parallel to each other are fixed by ribs 7. Any desired further arrangements of reinforcement tubes are possible within the scope of the invention for example four reinforcement tubes which are each arranged along all four sides or three parallel extending reinforcement tubes which extend along two sides and through the center of the pallet.

Figure 4:
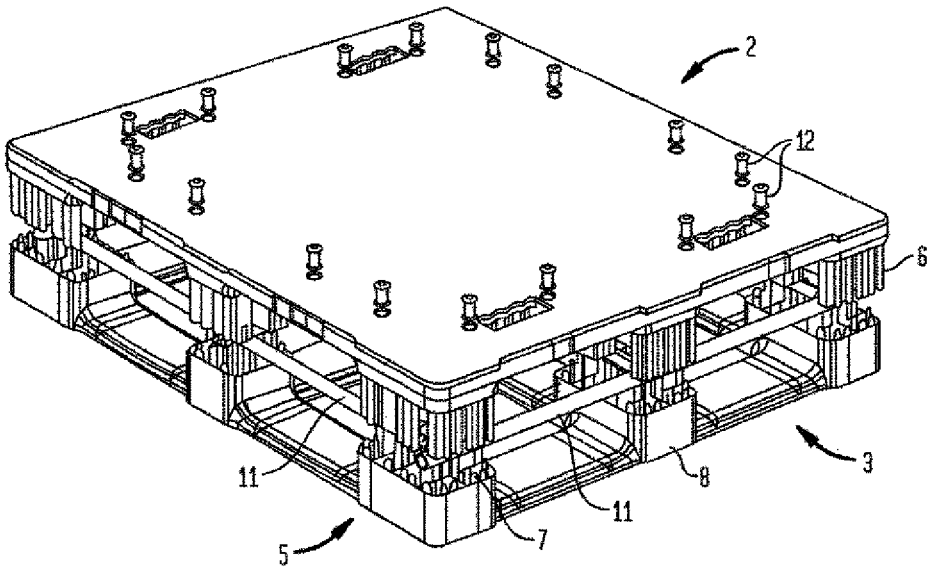
FIG. 4 shows a view of the pallet with arranged reinforcement tube.

According to FIG. 4, the top part 2 has on its surface multiple protruding pins 12 which can engage into corresponding openings on the bottom side of a plastic pallet stacked thereon and in this way can prevent a sliding of a pallet stack.

FIGS. 1-5 show a possible embodiment of the invention, wherein this embodiment includes 6 runners and 9 foot elements in the top and bottom part. Within the scope if the invention, further embodiments are also conceivable in particular with any smaller number of runners 4 and any smaller number of foot elements 5 in different arrangements. For example, a pallet of this type is possible with five runners, three of which extend in one direction and only two extend in the transverse direction along the sides of the pallet. Further possible pallets include only foot elements, for example four, six, eight or nine foot elements in the top and bottom part and no runners, or a pallet with two parallel runners along the sides of the pallet and three foot elements in the top and bottom part which in a row in the center of the pallet interconnect the top and bottom part.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein.

What is claimed is:

1. A plastic pallet, comprising:

a flat top part and a flat bottom part, each said top part and bottom part having foot elements which project perpendicularly from respective flat surfaces of the top and bottom parts, said foot elements each having ribs extending over an entire height of the foot elements, wherein the ribs of the foot elements of the top part and the ribs of the foot elements of the bottom part are fully insertable into each other over their entire length and include latching elements, and are fastenable to each other by latching engagement of the latching elements, wherein the latching elements are arranged at a lower end of the ribs of the foot element of the top part and a bottom end of the ribs of the foot elements of the bottom part, and wherein the foot elements of the bottom part each are surrounded contiguously on all sides by a walling.

2. The plastic pallet of claim 1, wherein the ribs of the foot elements of the bottom part and the top part each have semi-circular recesses for receiving reinforcement tubes, wherein the semi-circular recesses in the ribs of the foot element of the lower part are arranged at a top end of the ribs of the foot elements of the bottom part above a top rim of the walling of the bottom part.

3. The plastic pallet of claim 1, wherein the ribs of the foot elements of the top part or the bottom part each have one or multiple projections for fixing a reinforcement tube.

4. The plastic pallet of claim 1, wherein each of the foot elements has one or two pairs of latching connections.

5. The plastic pallet of claim 1, wherein the foot elements that project from the top part are integrated as one piece with the top part and the foot elements that project from the bottom part are integrated as one piece with the bottom part.

6. The plastic pallet of claim 1, wherein the top part and the bottom part each have three or more said foot elements.

7. The plastic pallet of claim 6, further comprising from 1-3 runners extending parallel to each other.

8. The plastic pallet of claim 6, further comprising 2 or 3 runners extending in a first direction and 1-3 runners extending parallel to each other in a direction transverse to the first direction.

9. The plastic pallet of claim 1, wherein ribs of the foot element of the top part extend at a right angle to the wall of the foot element of the bottom part and touch the wall of the bottom part when the top part and the bottom part are fastened to one another.

10. The plastic pallet of claim 1, wherein the ribs of the foot element of the bottom part extend from one side of the surrounding wall to another side of the surrounding wall.

* * * * *